United States Patent [19]

Williams

[11] Patent Number: 5,076,305

[45] Date of Patent: Dec. 31, 1991

[54] APPARATUS FOR CLEANING BY RAPID VIBRATION

[75] Inventor: Kevin T. Williams, 2450 Jefferson St., Carlsbad, Calif. 92008

[73] Assignees: Kevin T. Williams; James M. Dreher, both of Carlsbad, Calif.

[21] Appl. No.: 566,494

[22] Filed: Aug. 13, 1990

[51] Int. Cl.[5] ..... B08B 3/12

[52] U.S. Cl. ..... 134/58 R; 134/184; 206/209; 206/362; 366/111

[58] Field of Search ..... 134/184, 1, 38, 58 R; 15/38; 366/111, 112; 68/355; 206/209, 209.1, 361, 362, 362.2, 362.3; 211/66

[56] References Cited

U.S. PATENT DOCUMENTS

| | | | |
|---|---|---|---|
| 2,945,251 | 7/1960 | Eichner | 206/209 X |
| 3,472,443 | 10/1969 | Blank et al. | 366/112 |
| 4,691,725 | 9/1987 | Parisi | 366/111 X |
| 4,930,532 | 6/1990 | Mayer | 134/184 |
| 4,991,609 | 2/1991 | Browning | 134/184 X |

FOREIGN PATENT DOCUMENTS

| | | | |
|---|---|---|---|
| 875201 | 8/1961 | United Kingdom | 68/3 SS |
| 2069829 | 9/1981 | United Kingdom | 206/362 |

*Primary Examiner*—Philip R. Coe
*Attorney, Agent, or Firm*—David L. Baker

[57] ABSTRACT

A vibrational cleaning apparatus is presented that has a base with a plurality of suction cup legs attached. Included is a reciprocating armature motor and a tubular housing releasingly attached to the base. The reciprocating armature motor imparts a vibrational pulse to the base. A support disc is releasingly attached to an inside surface of a wall of the tubular housing. A solution container is within the tubular housing and is in intimate contact with the disc. A spring clip, to releasingly suspend and retain items to be cleaned, is attached to the tubular housing. A timer switch, to activate the motor for preselected periods of time, is attached to and passes through the wall of the housing. A wallk plug extends through a base port in the base to the motor and is plugged into a source of AC power.

2 Claims, 1 Drawing Sheet

APPARATUS FOR CLEANING BY RAPID VIBRATION

BACKGROUND OF THE INVENTION

1. Field of the Invention

This invention relates to a liquid agitating apparatus having a reciprocating armature motor that imparts a vibratory motion to a liquid, such as a solvent, in a chamber to clean matter from objects such as paint brushes.

2. Description of the Related Art

In the past, the cleaning of brushes has been difficult. One soaked them in a solvent to soften the paint and then attempted to work the paint out of the bristles by hand. This method did not always satisfactorily clean the brush and it was somewhat damaging to the hands.

U.S. Pat. No. 2,896,649 to H. C. Faidley on July 28, 1959 describes an apparatus for cleaning by ultra-sonic vibrations having an ultra-sonic unit encased in a plaster of paris container, placing a solution in a solution container above the plaster container and pulsating the solution to clean items in a basket.

U.S. Pat. No. 3,399,869 to W. J. Loria, et al., on Sept. 3, 1968 show an electromagnet that pulsates and periodically allows a perforated plate to be expelled from and drawn back to the bottom of a container so as to create air bubbles through the holes in the plate as a solution passes through the holes.

U.S. Pat. No. 3,596,883 to K. H. Brech on Aug. 3, 1971 describes an ultrasonic cleaning apparatus that has a plurality of electroacoustic transducers attached to a container to cause cavitation of a liquid in the container.

SUMMARY OF THE INVENTION

The present invention provides an apparatus for cleaning by vibrating a container of cleaning solution. The apparatus is primarily used to clean paint brushes and has a suspension means to hold the brushes at a proper position in the solution to clean the bristles of the brush. The container that holds the solution or solvent is removable to facilitate changing dirty solution for clean solution as needed. The apparatus may be used for house type, artist or other brushes. The size of the apparatus depends on the size of the brushes the user intend to clean. A fairly small one could be conveniently placed or an artist's table to keep a number of brushes ready for use. A larger one would allow a house painter to keep a number of brushes clean and ready for color changes without having a brush prepared for each color. A timer allows the user to turn on the apparatus, let it clean the brushes, come back later and not worry about the apparatus running all day if forgotten. The motor produces a vibrational motion to the solution in the container through the base housing and support disc. The vibrating or oscillating solution cleans the brush bristles.

A vibrational cleaning apparatus is described that has a base and a plurality of suction cup legs attached to the base. There is a reciprocating armature motor and a tubular housing releasingly attached to the base. The reciprocating armature motor imparts a vibrational pulse to the base. There is a support disc releasingly attached to an inside surface of a wall cf the tubular housing. A solution container is within the tubular housing and is in intimate contact with the disc. There is a spring clip means, to releasingly suspend and retain items to be cleaned, attached to the tubular housing.

There is a timer switch means, to activate the motor for preselected periods of time, attached to and passing through the wall of the housing. An AC power source such as a wall plug extends through a base port in the base to the motor.

The vibrational cleaning apparatus may also have a lid for the container. There may be a plurality of wall vent ports in the wall of the tubular housing and a plurality of base vent ports in the base.

It is an object of this invention to provide an apparatus for cleaning brushes by vibrational agitation of a cleaning solution to remove material from the bristles, for example, paint and varnish.

It is another object of this invention to provide an economical and easy to use apparatus to clean brushes that does not entail placing the hands in a solvent or other cleaning solution for long periods of time.

DESCRIPTION OF THE PREFERRED EMBODIMENT

Figure 1:
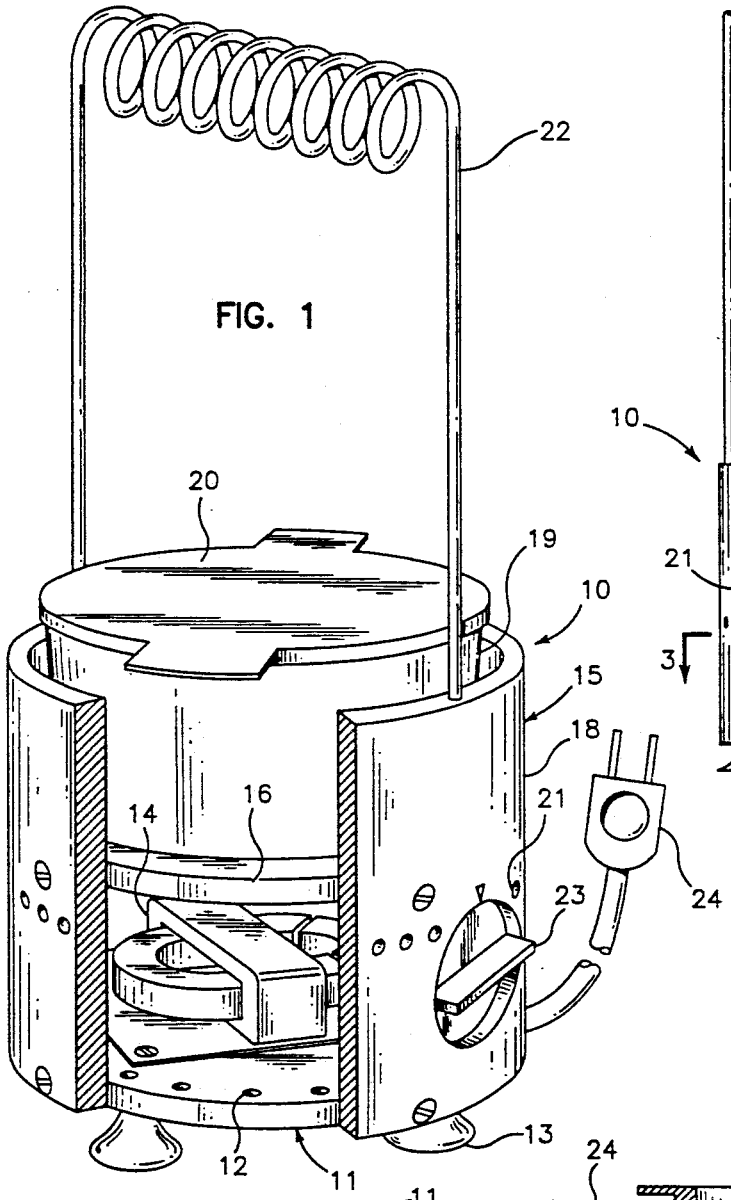
FIG. 1 is a perspective drawing, partly in section and partly in elevation, of the apparatus.
Figure 2:
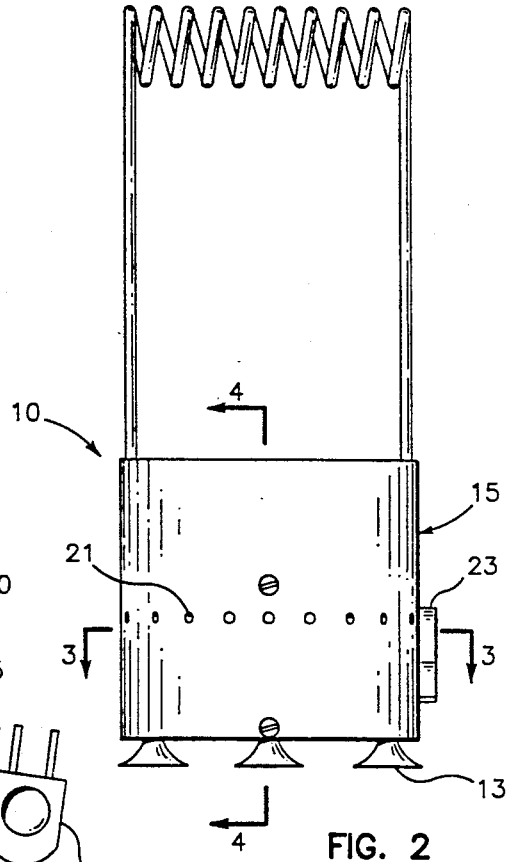
FIG. 2 is a front view of the apparatus.
Figure 3:
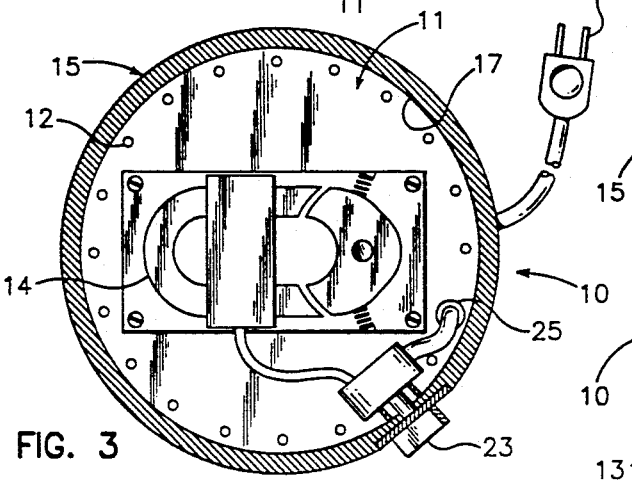
FIG. 3 is a cross-sectional view taken along lines 3—3 of FIG. 2.
Figure 4:
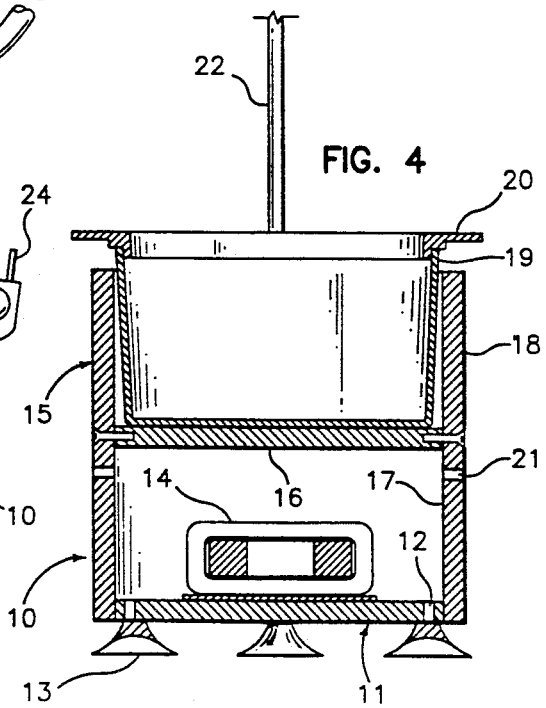
FIG. 4 is a cross-sectional view taken along lines 4—4 of FIG. 2.

FIGS. 1 through 4 show the Apparatus for cleaning 10. A vibrational cleaning apparatus 10 has a base 11, a plurality of base vent ports 12 in the base 11 and a plurality of suction cup legs 13 attached to the base. There is a reciprocating armature motor 14 attached to the base 11 to provide vibrations. A tubular housing 15 is releasingly attached to the base. A support disc 16 is releasingly attached to and in intimate contact with an inside surface 17 of a wall 18 of the tubular housing 15. There is a solution container 19 within the tubular housing. The container 19 is in intimate contact with the disc 16. A lid 20 is provided for the container 19 and sits on top of the open end of the container. There are a plurality of wall vent ports 21 in the wall 18 of the tubular housing 15. There is a spring clip means 22, to releasingly suspend and retain items (not shown) to be cleaned, attached to the tubular housing 15. There is a timer switch means 23, to activate the motor 14 for preselected periods of time, attached to and passing through the wall 18 of the housing 15. An AC power source, such as a plug 24, extends through a base port 25 in the base 11 to the motor 14 to provide AC power to the motor.

The foregoing descriptions and drawings of the invention are explanatory and illustrative only, and various changes in shape, sizes and arrangements of parts as well certain details of the illustrated construction ma be made within the scope of the appended claims without departing from the true spirit of the invention.

I claim:

1. A vibrational cleaning apparatus comprising:

a. a base;

b. a plurality of suction cup legs attached to the base;

c. a reciprocating armature motor attached to the base;

d. a tubular housing releasingly attached to the base;

e. a support disc releasingly attached to an inside surface of a wall of the tubular housing;

f. a solution container within the tubular housing and in intimate contact with the disc;

g. a spring clip means, to releasingly suspend and retain items to be cleaned, attached to the tubular housing;

h. a timer switch means, to activate the motor for preselected periods of time, attached to and passing through the wall of the housing; and i. an AC power source extends through a base port in the base to the motor.

2. A vibrational cleaning apparatus as described in claim 1 further comprising:

a. a cover for the container;

b. a plurality of wall vent ports in the wall of the tubular housing; and c. a plurality of base vent ports in the base.

* * * * *